US011738428B2

(12) United States Patent
Frenken

(10) Patent No.: US 11,738,428 B2
(45) Date of Patent: Aug. 29, 2023

(54) METHOD FOR OPERATING A HYDRAULICALLY ACTUATED WORK TOOL

(71) Applicant: GUSTAV KLAUKE GMBH, Remscheid (DE)

(72) Inventor: Egbert Frenken, Heinsberg (DE)

(73) Assignee: GUSTAV KLAUKE GMBH, Remscheid (DE)

( * ) Notice: Subject to any disclaimer, the term of this patent is extended or adjusted under 35 U.S.C. 154(b) by 382 days.

(21) Appl. No.: 17/265,066

(22) PCT Filed: Jul. 30, 2019

(86) PCT No.: PCT/EP2019/070509
§ 371 (c)(1),
(2) Date: Feb. 1, 2021

(87) PCT Pub. No.: WO2020/025615
PCT Pub. Date: Feb. 6, 2020

(65) Prior Publication Data

US 2021/0379746 A1 Dec. 9, 2021

(30) Foreign Application Priority Data

Aug. 1, 2018 (DE) ..... 10 2018 118 677.0

(51) Int. Cl.
*B25B 27/00* (2006.01)
*B25B 27/02* (2006.01)
*B25B 27/10* (2006.01)

(52) U.S. Cl.
CPC ..... *B25B 27/026* (2013.01); *B25B 27/10* (2013.01)

(58) Field of Classification Search
CPC ..... B25B 27/026; B25B 27/00; B25B 27/10
See application file for complete search history.

(56) References Cited

U.S. PATENT DOCUMENTS 5,195,042 A * 3/1993 Ferraro ..... H01R 43/0427 29/863
8,056,473 B2 11/2011 Frenken
(Continued)

FOREIGN PATENT DOCUMENTS

WO 2008138987 A2 11/2008
WO 2016005838 A1 1/2016
WO 2017129385 A1 8/2017

OTHER PUBLICATIONS

International Search Report for International Application No. PCT/EP2019/070509, dated Nov. 15, 2019, 4 pages.
(Continued)

*Primary Examiner* — Lee D Wilson
(74) *Attorney, Agent, or Firm* — Klintworth & Rozenblat IP LLP

(57) ABSTRACT

A method for operating a hydraulically actuated work tool having a work jaw is provided. Once an increase in force applied as a result of a hydraulic pressure has been reached, the work process does not require any further force or a maximum permissible hydraulic pressure has been reached. The hydraulic pressure is applied by a pump piston that travels through a pump path and a return path in each pump cycle. The hydraulic pressure is recorded over a time for a change from a pressure increase range to a pressure-maintaining range corresponding substantially to a specific pressure value from the pump path into the return path. At the end of a pump cycle, if the reached pressure-maintaining range exceeds a predefined pressure-maintaining range, an indication is concluded that the tool needs to be checked for a break in the work jaw.

8 Claims, 7 Drawing Sheets

(56) References Cited

U.S. PATENT DOCUMENTS

| | | | | |
|---|---|---|---|---|
| 2008/0289394 | A1 | 11/2008 | Mitchell | |
| 2017/0087709 | A1 | 3/2017 | Barezzani | |
| 2019/0030698 | A1 | 1/2019 | Frenken | |
| 2020/0230797 | A1* | 7/2020 | Frenken | B25F 5/00 |
| 2021/0379746 | A1* | 12/2021 | Frenken | B25B 27/026 |
| 2023/0060846 | A1* | 3/2023 | Westerby | G05B 19/02 |

OTHER PUBLICATIONS

English machine translation of WO 2008/138987 A1.
English machine translation of WO 2017/129385 A1.

* cited by examiner

METHOD FOR OPERATING A HYDRAULICALLY ACTUATED WORK TOOL

AREA OF TECHNOLOGY

The invention relates to a method for operating a hydraulically actuated work tool with a work jaw, wherein a work process requires an increase in a force applied as the result of a pressure in a hydraulic means, wherein once said increase has been reached, the work process requires no more higher force or a maximum permissible hydraulic force has been reached, wherein the hydraulic pressure is further applied with the aid of a piston pump, with a pump piston that travels through a pump path and a return path in each pump cycle, wherein, while the hydraulic pressure is recorded over time given a change from the pump path to the return path, a change takes place from a pressure increase range to a pressure-maintaining range that essentially corresponds to a specific pressure value.

PRIOR ART

With respect to prior art, reference must initially be made to WO 2016/005838 A1 (US 2017/0087709 A1). Known from the above given a crimping tool with two crimping jaws arranged pivotably to each other is to detect when a closed position of the crimping jaw has been reached by means of a sensor. The sensor system can involve monitoring the pressure in the hydraulic means and evaluating a pressure increase gradient more strongly than a predefined gradient to indicate that a closed position of the crimping jaw has been reached.

Much the same is also known from WO 2017/129385 A1 and WO 2008/138987 A2 (U.S. Pat. No. 8,056,473 B2).

SUMMARY OF THE INVENTION

Proceeding from the described prior art, the object of the invention is to further improve a method for operating a hydraulically actuated work tool.

This object is achieved by the subject matter of claim 1, wherein emphasis is placed on setting up the tool to monitor for a break in a work jaw, to which end a reached pressure-maintaining range is compared with a predefined pressure-maintaining range in a predefined pressure interval, or an acquired number of pressure-maintaining ranges in a pressure interval is compared with a number of pressure-maintaining ranges predefined for this pressure interval.

When generating a pressure in the hydraulic means with the use of a piston pump, a provided sensor system puts together a high-resolution pressure increase curve out of a sequence of step-like areas, wherein each step-like partial area corresponds to a pump cycle composed of a pump path and a return path. A rise in pressure in the hydraulic means produces an increase in the step height, as the result of a pump piston force required for a given pump path, and hence a corresponding increase in the distance between two consecutive pressure-maintaining ranges.

An evaluation of step height practically immediately yields force-path information, since in particular when using a piston pump, the hydraulic piston in first approximation practically always covers the same path per piston pump stroke during each pump stroke, here a piston stroke of the piston pump, so that the same quantity of hydraulic means is always conveyed. The accompanying (average) force over a piston pump stroke finds its equivalent in the step height.

As a consequence, the step height measure becomes a direct measure for the mechanical stiffness against which the respective pump works.

According to the invention, the value of the predefined pressure-maintaining range corresponds to a value at which the mechanical stiffness is practically only still determined—but at any rate to a considerable extent—by the work tool itself, and practically no longer by the part to be crimpled and/or one of the work jaws. In particular, the stiffness determined by the tool itself can be caused by the hydraulic piston coming into contact with the hydraulic cylinder, i.e., through direct exposure of the cylinder floor. As a rule, this type of direct exposure is not possible if the work jaws are intact. Even with the work jaws closed, the force path in this case still always passes through the jaw areas which, while they do have a higher stiffness, it is still lower than corresponds to the stiffness of the work tool itself. Therefore, this absolute value—the stiffness of the work tool itself—usually also represents a tool constant.

Once a specific or general work force as preferably likewise acquired via a sensor system has been reached, a signal to end the work process can be triggered according to the WO 2008/138987 A1 (U.S. Pat. No. 8,056,473 B2) cited at the outset, terminating the pump activity of the pump piston, and possibly, as also preferred, opening a return valve for the hydraulic means. This results in a spontaneous drop in the pressure increase curve, proceeding from a pressure peak that in the pressure increase curve denotes the pressure upon reaching the specific or general work force.

According to the invention, the mentioned tool constant or the value of the predefined pressure-maintaining range prescribes a maximum value. If the latter is reached by evaluating the respectively reached value for the pressure-maintaining range without the value for the specific work force having been acquired beforehand, as should routinely in itself be the case, this is detected as a break in the work jaw. The absolute value of the device constant (value of the predefined pressure-maintaining range) can be quickly recognized, in response to which the work tool is preferably turned off immediately.

A control/monitoring unit with a microprocessor can compare the values of the pressure-maintaining ranges reached at the end of a respective pump cycle with the predefined value of the pressure-maintaining range, which is drawn upon as the absolute value in the comparison.

For example, the value of the predefined pressure-maintaining range or the mentioned tool constant can be acquired (for the first time) by randomly introducing a work process, in which the hydraulic piston alone or to a considerable extent acts on the facing cylinder floor. The value acquired here can be stored as a reference value or tool constant for the work tool. A data storage can be provided for this purpose.

The reference measurement serving to acquire a tool constant can thus take place with at least one work jaw removed, for example, and alternatively given a work jaw moved to a non-operating position relative to the other work jaw, for example. Accordingly, no usual final work jaw position is here reached, in which the force path leads solely or to a considerable extent through the work jaw. A break in a work jaw is simulated by the absence of a work jaw or a work jaw or insert moved to a non-operating position.

For example, the work process can involve crimping, in particular crimping with a hydraulic crimping tool. Two pressing jaws comprising the work jaw are here usually moved relative to each other, for example one pressing jaw against a fixed pressing jaw, which is formed in the work jaw. A part to be crimped or a combination of parts to be crimped can be placed between the pressing jaws. A-first-increase in work force arises as long as the part or parts are elastically and/or plastically deformed by moving the pressing jaws together. If the jaws have been moved together, further increasing the work force practically only leads to an "on-block driving" of the pressing jaws. As a consequence, essentially only the elasticity or stiffness residing in one or both pressing jaws or work jaws is then still effective in resisting against a further rise in work force. With respect to this further increase, a modified-second-rise in work force can arise.

The transition into the stiffness of the tool as such, i.e., a reaching of the predefined pressure-maintaining range, relative to an undamaged work jaw can be established in the pressure increase curve proceeding from a lower pressure or a lower pressure stage. A comparably abrupt transition can take place from the lower pressure stage to the predefined pressure-maintaining range. In addition, this transition can further also arise at an earlier time relative to a comparable pressure increase curve given an undamaged work jaw, proceeding from an initiation of the work process.

In one possible embodiment, the user can further be given a visual and/or acoustic indication once the predefined pressure-maintaining range has been reached. For example, a visual indication can take place in the form of an activation of a lamp, for example an LED or the like, and alternatively given a possible arrangement of a display on the work tool via a corresponding visual display in the form of a warning symbol and/or clear text display.

For an acoustic indication, the work tool can have a loudspeaker, for example for emitting a signal tone.

In another possible embodiment, a (possibly temporary) deactivation of the work tool can take place when the predefined pressure-maintaining range has been reached or even exceeded, possibly accompanied by a visual and/or acoustic indication for the user.

With respect to an evaluation of the number of pressure-maintaining ranges predefined for this pressure interval, a number of 90 percent or less of pressure-maintaining ranges than corresponds to the predefined number of pressure-maintaining ranges can be taken as indicating that the tool must be checked for a break in the work jaw.

In this way, a significant increase in the step height (pump force) by comparison to a step height predefined for the work jaw within the pressure interval examined makes it possible to conclude that the work jaw has a tear or break. Given an increase in the step height, a smaller number of pressure-maintaining ranges correspondingly arises between an initial pressure and a final pressure of the examined pressure interval.

Preferably used here for a comparative measurement is a pressure interval, which is bounded by the end of a work process.

The control/monitoring unit here compares the number of pressure-maintaining ranges reached in the predefined pressure interval in the course of the work process with the number of desired pressure-maintaining ranges stored in this regard. For example, two to five pressure-maintaining ranges can be predefined within the pressure interval. By contrast, if a number of pressure-maintaining ranges that is 10 percent or more smaller than the predefined number is acquired in the pressure interval drawn upon for the comparative measurement, for example only two acquired pressure-maintaining ranges given a desired value of three pressure-maintaining ranges, this can also point to a break in the work jaw.

Once the mentioned 90 percent or less of pressure-maintaining ranges has been reached, the user of the work tool can here also be given a visual and/or acoustic indication, wherein a deactivation of the work tool can further possibly take place even if the mentioned 90 percent or less of the pressure-maintaining ranges are exceeded.

According to the method, the tool is set up to monitor for a break in the work jaw. The tool can here have at least one sensor for acquiring the hydraulic pressure, further preferably electronics for evaluating the acquired sensor data, along with electronics, for example in the form of a microprocessor, for comparison of the acquired data with predefined data reserved in an internal data storage, analysis and possibly output of a signal.

Monitoring can take place by comparing a reached pressure-maintaining range with a predefined pressure-maintaining range. Alternatively or additionally thereto, a comparison can be made between acquired pressure-maintaining ranges and a number of predefined pressure-maintaining ranges in a predefined pressure interval.

As also preferred, a range that starts at one fifth and one twentieth of the permissible maximum pressure can be predefined as the relevant pressure interval included in the evaluation. At an exemplarily permissible maximum pressure of 600 to 800 bar, a pressure interval to be checked can thereby be provided that begins at 30 to 160 bar, for example, further at 60 to 80 bar, for example. The end of the pressure interval preferably always comes upon reaching the pressure value that shuts down the pumping process.

The relevant pressure interval that is drawn upon for the evaluation can be derived by recording the pressure in the pressure increase curve over a period of time, starting at the time of an initial pressure and ending at a time where the end of the work process has come, thereby yielding a final complete pressure interval.

In terms of the disclosure, the ranges or value ranges or multiple ranges indicated above and below also include all intermediate values, in particular in 1/10 increments of the respective dimension, meaning potentially dimensionless as well. For example, the indication 30 to 160 bar also contains the disclosure of 30.1 to 160 bar, 30 to 159.9 bar, 30.1 to 159.9 bar, etc. This disclosure can serve on the one hand to bound a mentioned range limit from below and/or above, but alternatively or additionally to disclose one or several singular values from a respectively indicated range.

BRIEF DESCRIPTION OF THE DRAWINGS

While the invention is explained below based upon the attached drawing, the latter only shows exemplary embodiments. A part that is only described with reference to one of the exemplary embodiments and is not replaced by another part in an additional exemplary embodiment based upon the characteristic emphasized therein is thus also described as an at least possible present part for this additional exemplary embodiment. The drawing shows:

FIG. 3 the magnification of area III on FIG. 2, relating to a position upon reaching the end of the work process given a proper work jaw;

DESCRIPTION OF THE EMBODIMENTS

Figure 1:
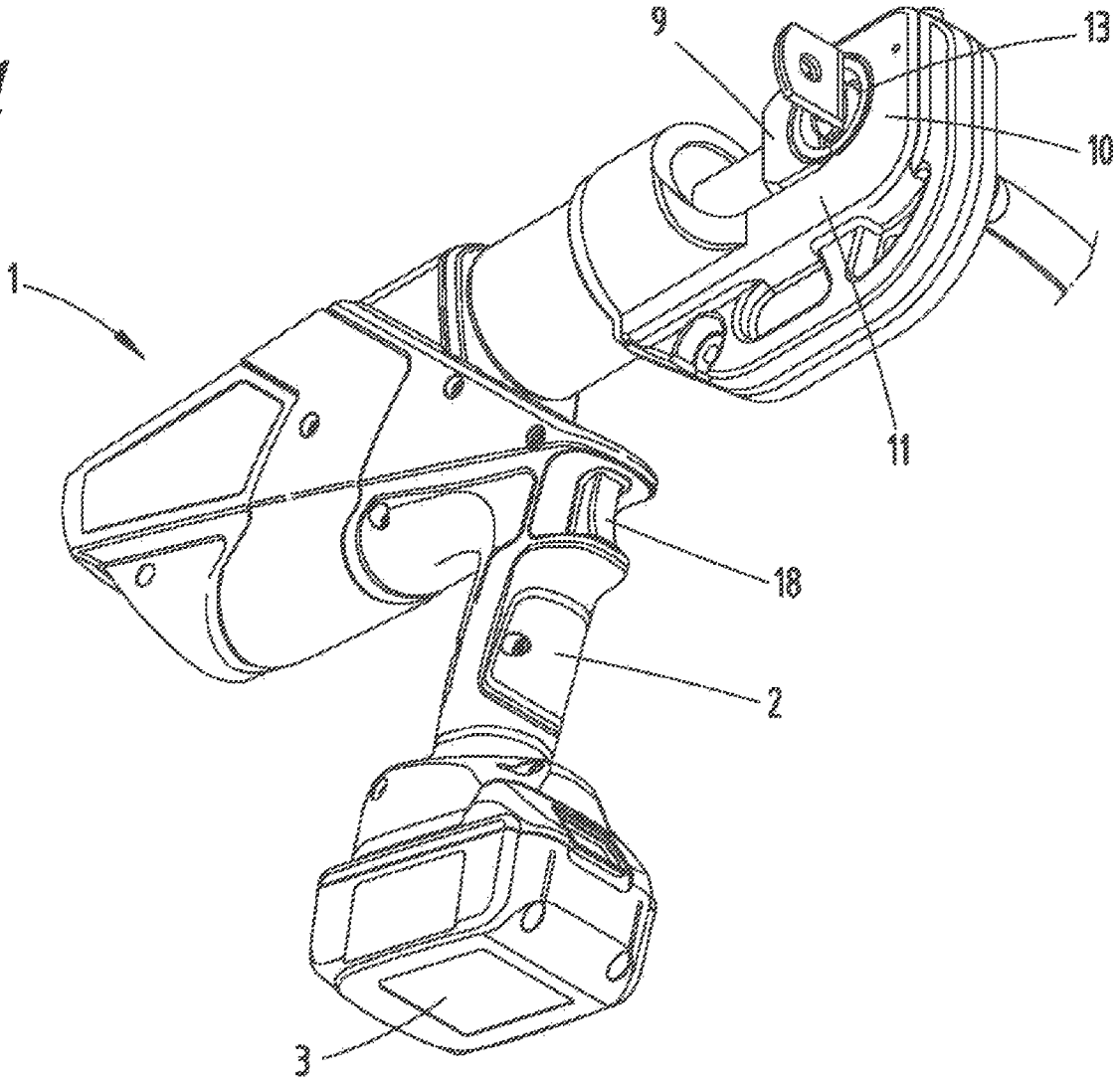
FIG. 1 a perspective view of a hydraulically actuatable work tool in the form of a crimping tool with a work jaw.
Figure 2:
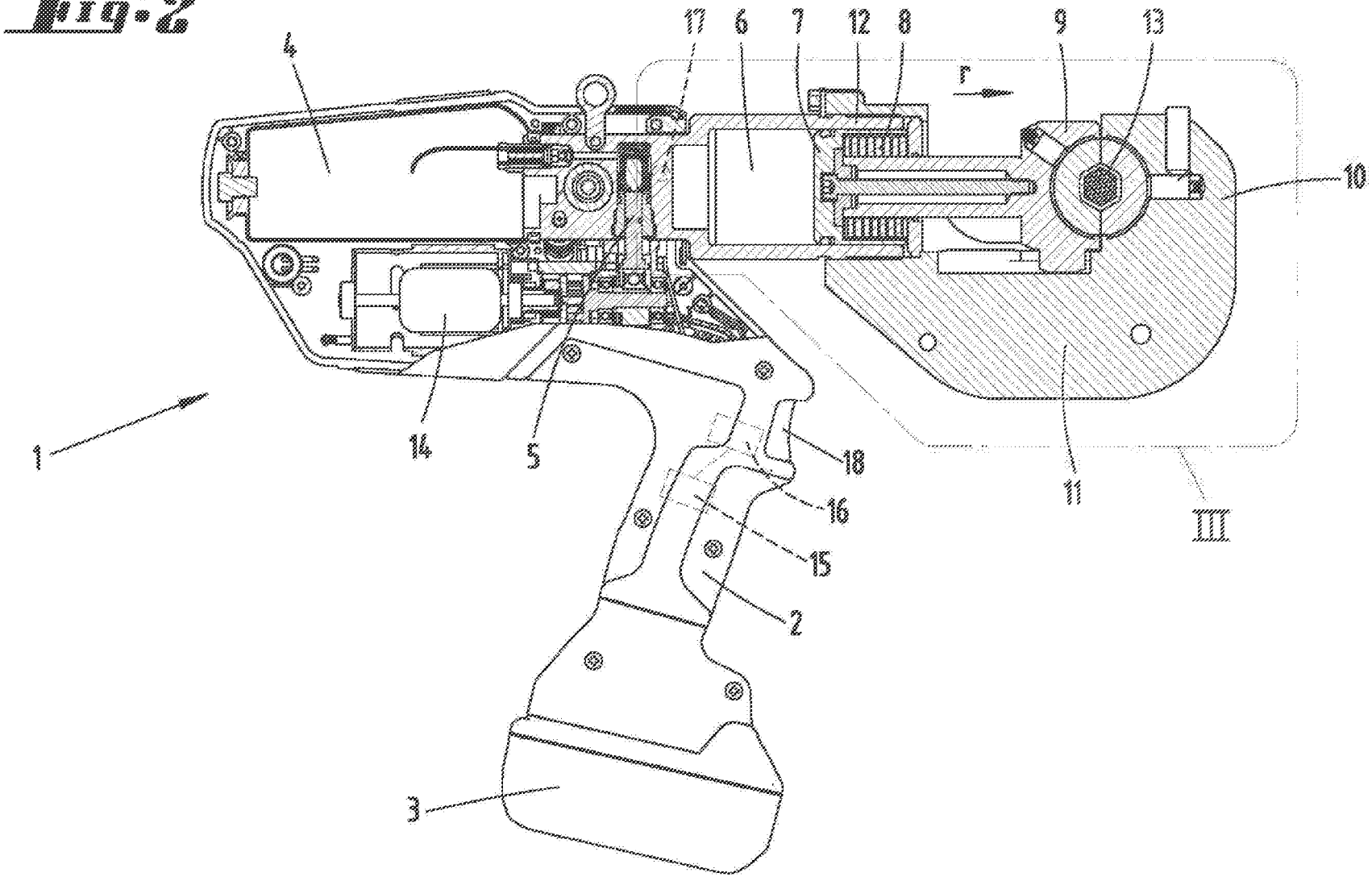
FIG. 2 the work tool according to FIG. 1 in a partially cut side view.

Initially shown and described with reference to FIGS. 1 and 2 is a hydraulically actuatable work tool 1, herein in the form of a crimping tool.

The work tool 1 can have a handle 2, and further an accumulator 3 if the tool is to be operated wirelessly. A connection by means of an electric cable to a supply via an electrical network is also possible, however.

Figure 7:
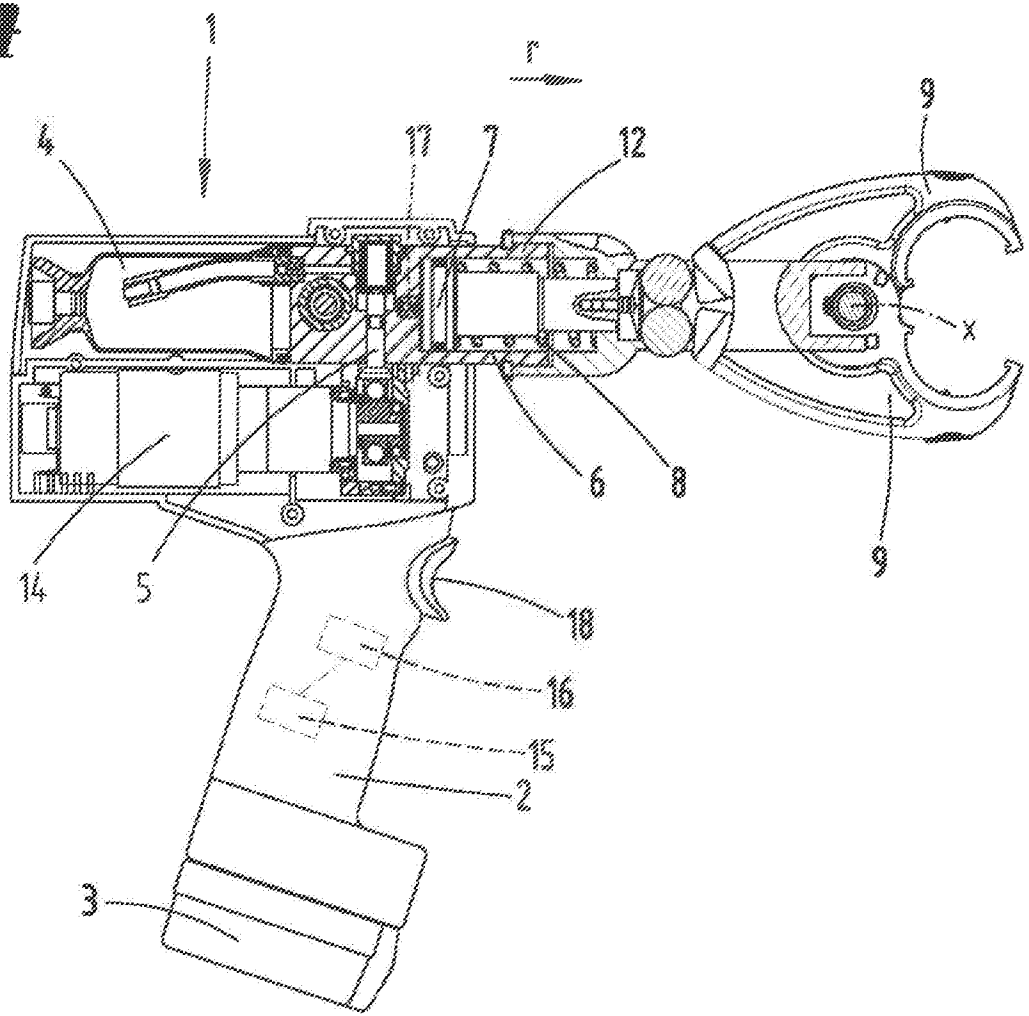
FIG. 7 a sectional view according to FIG. 2 relating to an alternative embodiment of the work jaws.

The hydraulic work tool 1 can further have a hydraulic tank 4. A pump, for example a piston pump 5, can be used to pump hydraulic means out of the hydraulic tank 4 into a hydraulic cylinder 6. By pumping the hydraulic means into the hydraulic cylinder 6, a hydraulic piston 7 can be moved into the hydraulic cylinder 6 between an initial position and a final position, with the latter being exemplarily shown on FIG. 2. The hydraulic piston 7 can be exposed to the action of a restoring spring 8. FIG. 7 relates to a work tool 1 in another embodiment, and depicts the initial piston position. FIG. 2 also shows a piston illustration corresponding to FIG. 3 with proper work jaws.

By moving the hydraulic piston 7, a movable work jaw 9 in the exemplary embodiment according to FIGS. 1 to 3 can be shifted against a fixed work jaw 10.

As evident from the illustrations, the fixed work jaw 10 can be essentially L-shaped in relation to a longitudinal section depicted on FIGS. 2 and 3, with a longer leg 11 that faces in the displacement direction r of the hydraulic piston 7 and is fixed on the cylinder wall 12 of the work tool 1, and an L-leg that runs transverse to the leg 11 and essentially forms the fixed work jaw 10 that acts against the movable work jaw 9.

Overall, this results in a pressing space enclosed in essentially a C-shaped manner in the basic work position, which can accommodate a part to be crimped, a pellet 13. For example, the pellet 13 can consist of a sleeve and a tube, which are to be crimped together, or also of a cable and a cable lug, as depicted.

In the work tool 1 shown on FIG. 7, movable work jaws 9 can be swiveled against each other by the hydraulic piston 7 for crimping purposes. The respective swiveling axis x of the work jaws 9 runs transverse to the displacement direction r.

The piston pump 5 can be driven by means of an electric motor 14, which can receive its power supply via the already mentioned accumulator 3, or for example also via the also mentioned network cable.

As also preferred, the work tool 1 can further have a data processing device 15 suitable for evaluating transmitted measured values, which is schematically illustrated on FIG. 2. Such a tool preferably also has a control device 16. The latter is connected by a cable to the data processing device 15.

The functions of the data processing device 15 and the control device 16 can also be performed by a uniform electronic component. For example, the control device can directly conclude a work process autonomously of any devices.

The hydraulic work tool 1 can further have a sensor 17 for acquiring a pressure in the hydraulic means. The pressure of the hydraulic means is preferably measured by the sensor 17 in the hydraulic cylinder 6.

The sensor 17 delivers respective measured values in very short time intervals. In particular, the time intervals measure under one second, further preferably under one tenth of a second. Such a time interval can also measure only one or several milliseconds.

Involved in particular is an electronic sensor, for example which can likewise be supplied with electrical power by the accumulator 3.

For example, concluding a work process can involve moving a work part, such as the movable work jaw 9 in a crimping tool, back into an initial position upon reaching a predefined pressing force, or initiating such a return movement. In a hydraulic pressing tool of the kind described, the initiation can in particular involve retracting the hydraulic piston 7 while returning hydraulic means from the hydraulic cylinder 6 into the hydraulic tank 4. As a rule, this involves in particular opening a return valve, and preferably also turning off the pump simultaneously with the mentioned opening.

While performing a crimping process (work process), for example with the hydraulic work tool in the form of a crimping tool, a hand-actuated switch 18 is used to initiate a crimping operation after inserting the pellet 13 into the pressing space. As it performs a plurality of piston strokes, the piston pump 5 then begins to pump hydraulic means out of the hydraulic tank 4 into the hydraulic cylinder 6.

Figure 5:
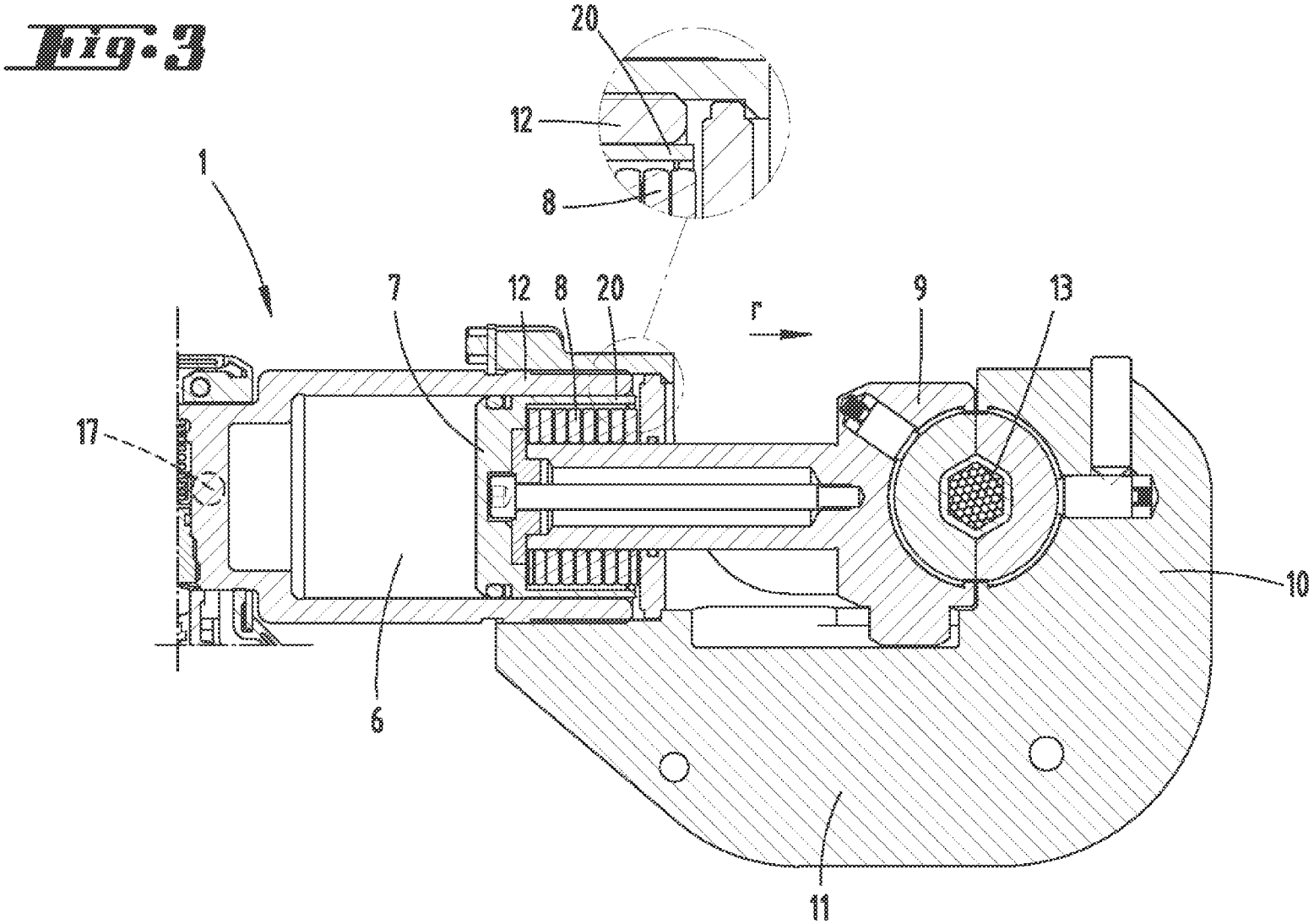
FIG. 5 an illustration of the pressure increase in a hydraulic means of the work tool while performing a work process given a proper and broken work jaw.

FIG. 5 shows a first pressure increase curve K, relating to a proper crimping of a pellet 13 using undamaged work jaws 9, 10.

In the illustration, the pressure is recorded on the ordinate, and the time t is recorded on the abscissa. A specific increase in pressure over time t takes place, wherein different slopes arise relative to the pressure increase curve K.

Figure 6:
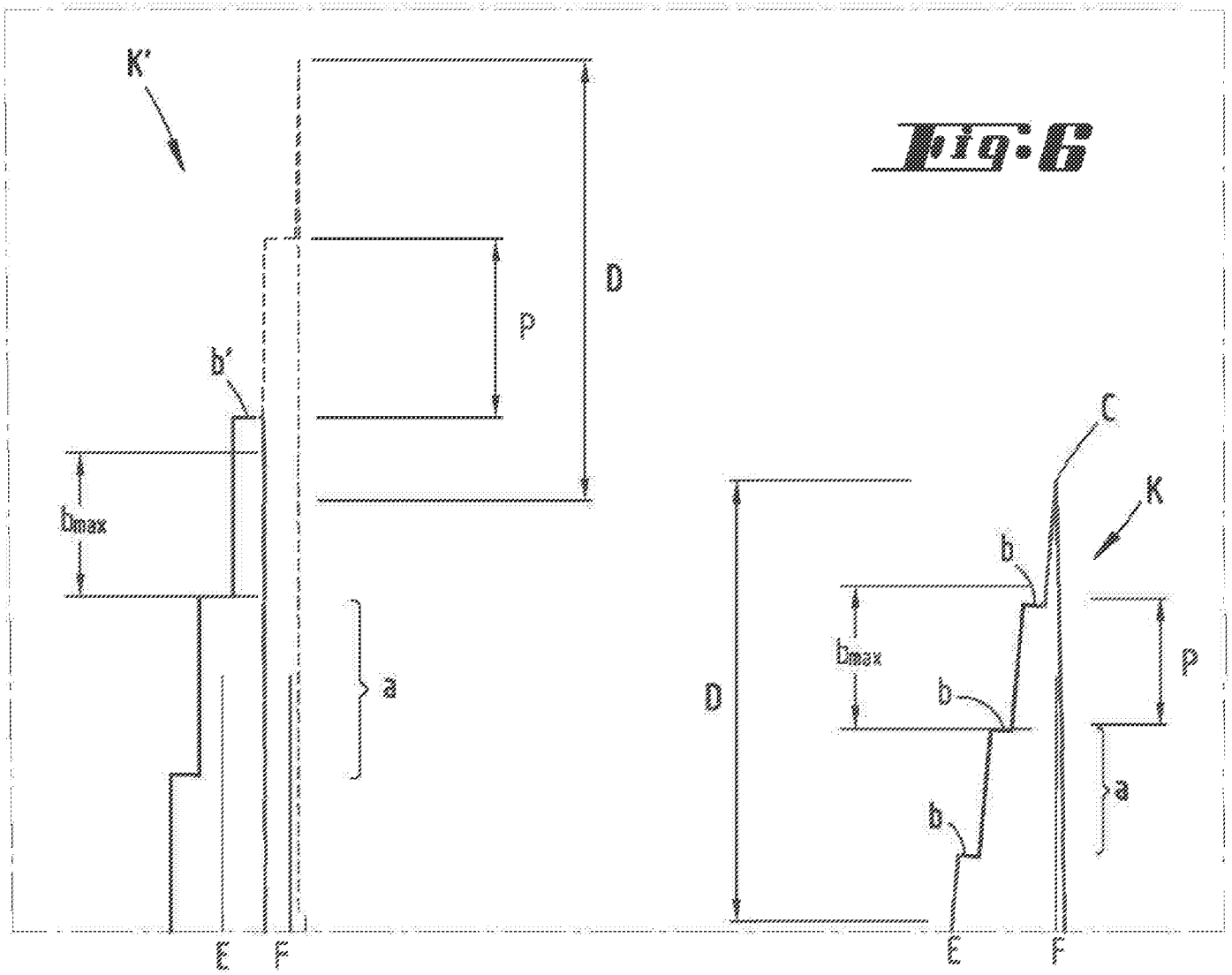
FIG. 6 the magnification of area VI on FIG. 5.

As also evident in particular from the magnified illustration on FIG. 6, a change between a pressure increase range a and pressure-maintaining range b takes places while recording the hydraulic pressure in the pressure increase curve K as a function of the pump path and return path of the hydraulic piston 7.

This yields an overall stepped progression of the pressure increase curve K.

The storage of the data processing device 15 and/or the control device 16 can store a specific absolute value, which relates to a stiffness of the tool, in particular of the hydraulic cylinder 6, can be provided as a tool constant, and is drawn upon for comparison purposes with respect to an actually acquired pressure-maintaining range b, b'. Exceeding the value of the predefined pressure-maintaining range $b_{max}$, for example by 5 percent or more, but possibly already by less than 5 percent, for example 1 percent or 2.5 percent, can lead to a signal for ending the work process, if necessary additionally or also alternatively to triggering a visual and/or acoustic signal. If the value for the predefined pressure-maintaining range $b_{max}$ is exceeded, it can be concluded that there is a break 19 in the work jaw 10.

Figure 4:
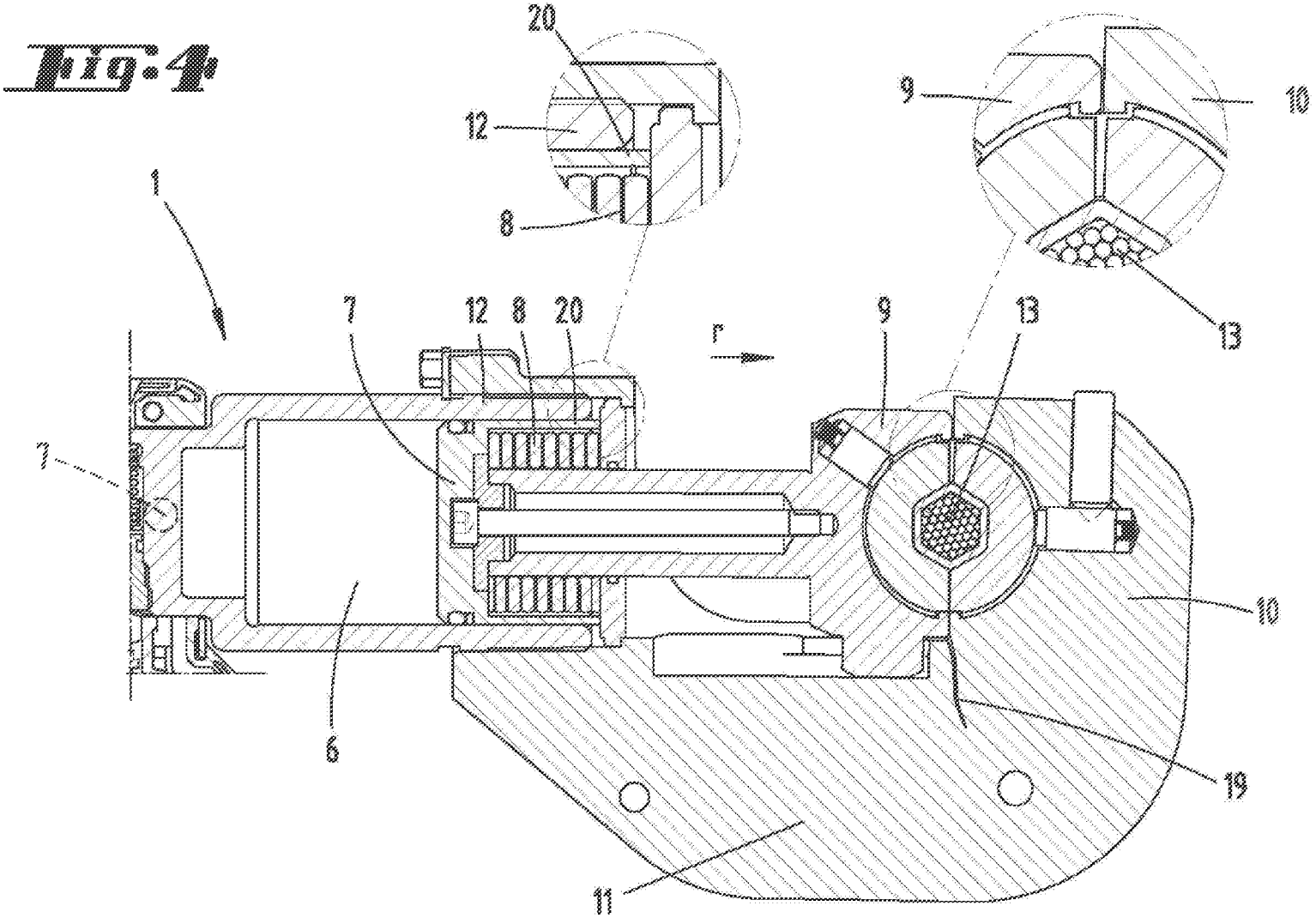
FIG. 4 an illustration corresponding to FIG. 3, but with a work jaw having a break.
Figure 5:
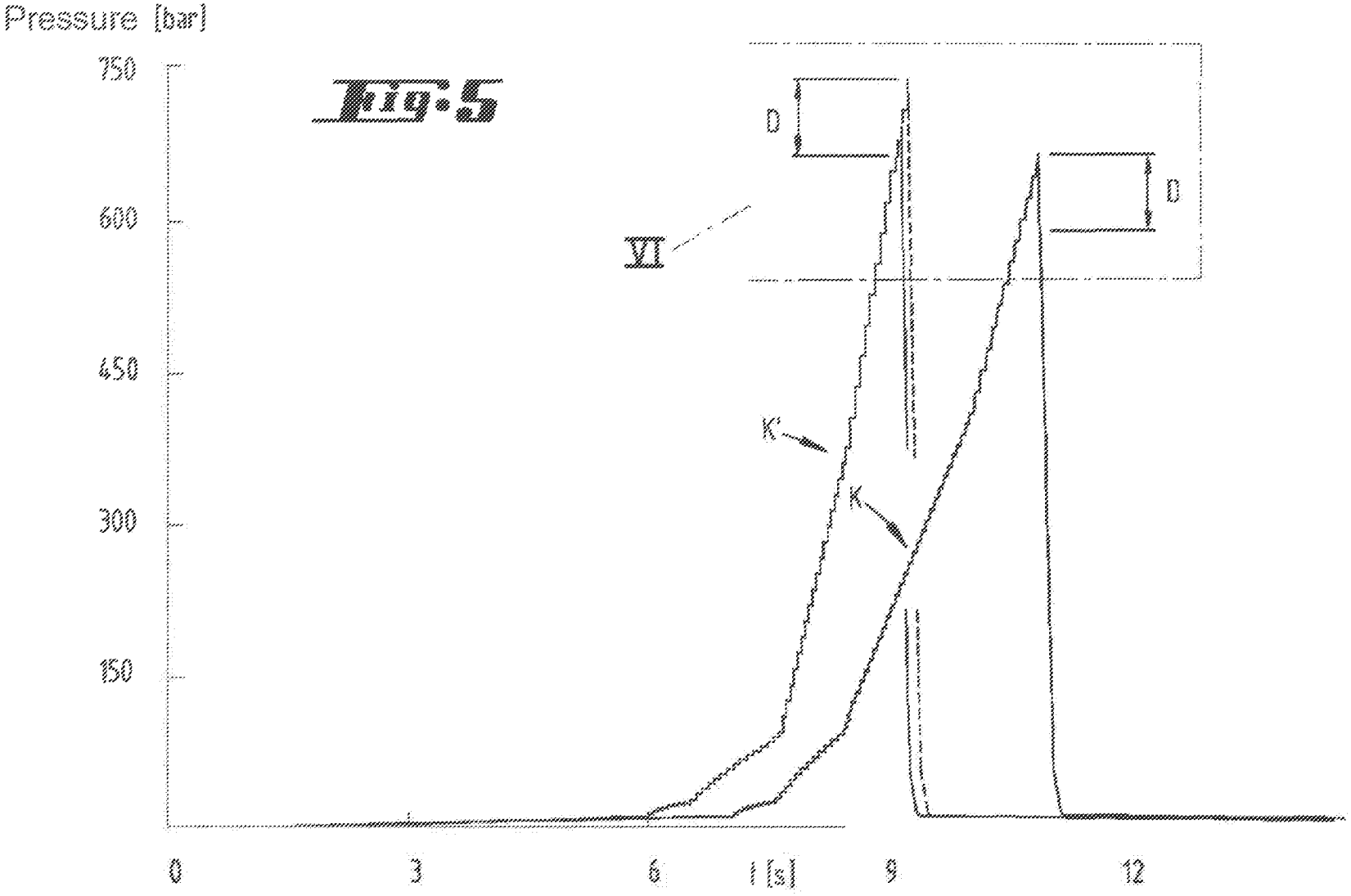

Such a constellation with a broken work jaw 10 is exemplary shown on FIG. 4. In particular, the break 19 in the form of a tear arises in the connection area of the work jaw 10 or of the respective leg to the leg 11 that is essentially subjected to a bending stress.

The formation of a break can result in an incomplete and improper crimping of the pellet 13 (see magnified view on FIG. 4, in which the pressing jaws are not moved together).

In this improper design of the work jaw 10, the free edge of the piston wall 20 can further hit the facing floor of the hydraulic cylinder 6 on the end face (see additional magnified view on FIG. 4). This hitting position is not reached during a conventional crimping with a proper work jaw 10 according to the illustration on FIG. 3. Rather, the permissible maximum pressure in the hydraulic cylinder 6 is reached before the piston wall 20 comes into contact with the cylinder floor, after which the hydraulic piston 7 is made to return by the spring force (after opening the return valve).

FIG. 5 shows another pressure increase curve K', relating to the pressure gradient using a work jaw 10 in which a break 19 is present.

As evident in particular from the magnified view on FIG. 6, a proper crimping with correspondingly intact work jaws 9 yields pressure-maintaining ranges b, whose acquired values (heights) always lie below the value of the predefined pressure-maintaining range $b_{max}$ until the specific or general work force C has been reached. As a result, the exemplary pressing process can be properly executed until the work force C has been reached.

By contrast, if a pressure-maintaining range b' is acquired whose pressure value exceeds the maximum pressure value of the predefined pressure-maintaining range $b_{max}$ according to the pressure increase curve K' shown on FIG. 6, the measurement and comparison result derived therefrom leads to the stored measure (acoustic and/or visual signal and/or, as schematically depicted, deactivation, etc.). With respect to the aforementioned measurement diagram, a dashed line on FIG. 6 shows the additional pressure value measurement course that at least theoretically arises without deactivation.

In an alternative method or one combined with the concept described above, the number of pressure-maintaining ranges b can be acquired within a pressure interval D that comprises a plurality of pressure increase and pressure-maintaining ranges a and b, and hence a plurality of pump cycles P.

In the exemplary embodiment shown, the pressure interval D comprises roughly the area on the order of 10 percent relative to a maximum pressure leading to a deactivation or maximum pressure reached as the upper end. For example, if this maximum pressure measures 750 bar, this results in a pressure interval D over a pressure increase of 75 bar.

With respect to recording the pressure in the pressure increase curve K over time t, the pressure interval D starts with an initial pressure E, and ends in a final pressure F, which is preferably also the cut-off pressure for the pump.

As evident in particular from the magnified view on FIG. 6, a lower number of pressure-maintaining ranges b' by comparison to the predefined number of pressure-maintaining ranges as shown in the pressure increase curve K arises in relation to the pressure increase curve K' given a broken work jaw 9, 10 over the same pressure interval D, here as well correspondingly over the same exemplary pressure range of 75 bar up until the end of the work process in the final pressure F. According to the illustration, only two pressure-maintaining ranges b' can thus arise within the pressure interval D given a broken work jaw 10. By contrast, the reference value for an intact work jaw is three according to the pressure increase curve K. The respective measurement correspondingly yields a number of pressure-maintaining ranges b' that corresponds to two thirds of the predefined number of pressure-maintaining ranges b.

REFERENCE LIST

| | |
|---|---|
| 1 | Work tool |
| 2 | Handle |
| 3 | Accumulator |
| 4 | Hydraulic tank |
| 5 | Piston pump |
| 6 | Hydraulic cylinder |
| 7 | Hydraulic piston |
| 8 | Return spring |
| 9 | Work jaw |
| 10 | Work jaw |
| 11 | Leg |
| 12 | Cylinder wall |
| 13 | Pellet |
| 14 | Electric motor |
| 15 | Data processing device |
| 16 | Control device |
| 17 | Sensor |
| 18 | Switch |
| 19 | Break |
| 20 | Piston wall |
| a | Pressure increase range |
| b | Pressure-maintaining range |
| b' | Pressure-maintaining range |
| $b_{max}$ | Pressure-maintaining range (predefined) |
| r | Displacement direction |
| t | Time |
| x | Swiveling axis |
| C | Work force |
| D | Pressure interval |
| E | Initial pressure |
| F | Final pressure |
| K | Pressure increase curve |
| K' | Pressure increase curve |
| P | Pump cycle |

The invention claimed is:

1. A method for operating a hydraulically actuated work tool with a work jaw, wherein a work process requires an increase in a force applied as the result of a pressure in a hydraulic means, wherein once said increase has been reached, the work process requires no more higher force or a maximum permissible hydraulic force has been reached, wherein the hydraulic pressure is further applied with the aid of a piston pump, with a pump piston that travels through a pump path and a return path in each pump cycle, wherein, while the hydraulic pressure is recorded over time given a change from the pump path to the return path, a change takes place from a pressure increase range to a pressure-maintaining range that essentially corresponds to a specific pressure value, characterized in that the work tool is set up to monitor for a break in the work jaw, to which end a reached pressure-maintaining range is compared with a predefined pressure-maintaining range in a predefined pressure interval, or an acquired number of pressure-maintaining ranges in a pressure interval is compared with a number of pressure-maintaining ranges predefined for this pressure interval, wherein relative to the reached pressure-maintaining range, it is concluded that checking the tool for a break in the work jaw is indicated if the reached pressure-maintaining range exceeds the predefined pressure-maintaining range.

2. The method according to claim 1, wherein if the reached pressure-maintaining range exceeds the predefined pressure-maintaining range, the user of the work tool is given a visual and/or acoustic indication.

3. The method according to claim 2, wherein a range of between one fifth and one twentieth of the permissible maximum pressure is predefined as the pressure interval.

4. The method according to claim 3, wherein in relation to the recording of pressure over time, an interval starting with an initial pressure up to a time at which the end of a work process has arisen, and thus the last complete pressure interval comes about, is used as the pressure interval for evaluation purposes.

5. The method according to claim 1, wherein a number of 90% or less of pressure-maintaining ranges than corresponds to the predefined number of pressure-maintaining ranges can be taken as indicating that the tool must be checked for a break in the work jaw.

6. The method according to claim 1, wherein a range of between one fifth and one twentieth of the permissible maximum pressure is predefined as the pressure interval.

7. The method according to claim 6, wherein in relation to the recording of pressure over time, an interval starting with an initial pressure up to a time at which the end of a work process has arisen, and thus the last complete pressure interval comes about, is used as the pressure interval for evaluation purposes.

8. The method according to claim 1, wherein in relation to the recording of pressure over time, an interval starting with an initial pressure up to a time at which the end of a work process has arisen, and thus the last complete pressure interval comes about, is used as the pressure interval for evaluation purposes.

* * * * *